US007585065B2

(12) United States Patent
Tsuda

(10) Patent No.: US 7,585,065 B2
(45) Date of Patent: Sep. 8, 2009

(54) INK-JET RECORDING APPARATUS

(75) Inventor: Masashi Tsuda, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 582 days.

(21) Appl. No.: 11/535,466

(22) Filed: Sep. 26, 2006

(65) Prior Publication Data

US 2007/0076041 A1 Apr. 5, 2007

(30) Foreign Application Priority Data

Sep. 30, 2005 (JP) ..... 2005-287816

(51) Int. Cl.
*B41J 2/175* (2006.01)
*B41J 2/015* (2006.01)

(52) U.S. Cl. ..... 347/93; 347/21

(58) Field of Classification Search ..... 347/93, 347/21, 20, 29, 30, 33

See application file for complete search history.

(56) References Cited

U.S. PATENT DOCUMENTS 6,062,390 A 5/2000 Nakamura
6,357,854 B1 * 3/2002 Igval et al. ..... 347/36

FOREIGN PATENT DOCUMENTS

JP 1999001046 A 1/1999
JP 2001328269 A 11/2001

* cited by examiner

*Primary Examiner*—Shih-wen Hsieh
(74) *Attorney, Agent, or Firm*—Baker Botts L.L.P.

(57) ABSTRACT

One embodiment of the invention relates to an ink-jet recording apparatus comprising an ink-jet head with an ink passage having an inner volume and a preservative in the ink passage in a preservative residual ratio of no greater than 10%. Another embodiment of the invention relates to a preservative having water, a penetrant, and a humectant. A further embodiment of the invention relates to a processing method involving filling an inner volume of an ink passage in an ink-jet recording apparatus with a preservative and removing a portion of the preservative from the inner volume such that a preservative residual ratio is no greater than 10%.

20 Claims, No Drawings

INK-JET RECORDING APPARATUS

BACKGROUND OF THE INVENTION

1. Field of the Invention

The present invention relates to storing ink-jet recording apparatuses for shipping or long-term storage.

2. Description of Related Art

An ink-jet recording apparatus is a recording apparatus for ejecting ink onto a recording material such as recording paper. It may use a thermal ink-jet system to generate bubbles through rapid heating and then ejecting out fine ink droplets through fine nozzles owing to the resulting pressure. It may also use a piezoelectric ink-jet system which employs a piezoelectric element for ejecting out fine ink droplets.

When either type of ink-jet recording apparatus is shipped, the ink passage in the ink-jet head is filled with a preservative. This preservative reduces or prevents damages to the ink passage, such as damage by oxidation. The preservative also improves the ease with which ink may be introduced into the ink-jet head when the ink-jet recording apparatus is used for the first time. Specifically, the preservative helps allow the ink to be smoothly introduced into the ink-jet head without forming unwanted bubbles.

The preservative conventionally has a good ability to wet the material that makes up the ink passage of the ink-jet head. This facilitates the initial introduction of the ink into the ink-jet head.

Nevertheless, the ink passage of the ink-jet head comprises a metal member formed of aluminium, stainless steel or the like, a piezoelectric element, a heating element, as well as an adhesive for bonding them, and also rubber members such as a cap and a sealing gasket to cover and seal up the ink-jet head nozzle. Accordingly, when the preservative is kept in contact with the constitutive material of the ink passage for a long period of time, then the preservative may penetrate into the constitutive material of the ink passage, especially the adhesive and the rubber member thereof. The constitutive components may be dissolved in the preservative, and the dissolved components may precipitate before and after introduction of ink into the ink passage of the ink-jet head, therefore causing printing failure due to nozzle clogging and the like.

SUMMARY OF THE INVENTION

One object of the present invention is to reduce or prevent the preservative from dissolving constitutive components of the constitutive material of an ink passage into a preservative even when the ink passage is filled with the preservative during shipping or for long-term storage of the ink-jet recording apparatus. Another object is to reduce or prevent the ink-jet failure to be caused by the use of the preservative.

Accordingly, one embodiment of the invention relates to an ink-jet recording apparatus comprising an ink-jet head comprising an ink passage having an inner volume and a preservative in the ink passage, such that a preservative residual ratio is no greater than 10% of the inner volume.

A further embodiment of the invention relates to a processing method comprising filling an inner volume of an ink passage in an ink-jet recording apparatus with a preservative and removing a portion of the preservative from the inner volume, such that a preservative residual ratio is no greater than 10%.

Other objects, features, and advantages will be apparent to those skilled in the art from the following detailed description and accompanying drawings.

DETAILED DESCRIPTION OF EMBODIMENTS OF THE INVENTION

The present inventor has found that, when an ink-jet recording apparatus is stored with the ink passage filled with a preservative, the preservative may cause ink-jet failure. This failure may be significantly reduced by controlling the residual amount of the preservative in the ink passage of the stored ink-jet head.

The residual volume of the preservative relative to the inner volume of the ink passage of the ink-jet head is hereinafter referred to as a "preservative residual ratio". The inner volume of the ink passage means the inner volume of the ink passage in the ink-jet head including a recording head and a damper unit which stores ink to be fed into the recording head. This does not include the inner volume of the ink cartridge to be fitted to the ink-jet head and, when an additional ink tank is provided separately from the inkjet head, this does not also include the inner volume of the tube for feeding ink from the ink tank to the ink-jet head.

The ink-jet recording apparatus of an embodiment of the invention may be characterized in that the preservative residual ratio in the ink passage of the ink-jet head is at most about 10% of the inner volume of the ink passage.

If the preservative residual ratio in the ink passage of the ink-jet head is larger than about 10%, then the absolute amount of the components dissolved from the constitutive material of the ink passage by the preservative increases. This causes the amount of precipitates formed after ink is introduced into the ink-jet head to increase, resulting in ink-jet failure. Irrespective of the structure of the ink-jet head, this preservative-derived ink-jet failure can be reduced or prevented when the preservative residual ratio is at most about 10%.

Regarding the lower limit of the preservative residual ratio, the ability to introduce ink into the ink passage may be improved so long as the inner wall of the passage is wetted with the preservative. Accordingly, the ink passage may be filled with a preservative, which is then discharged. The ink passage may not be intentionally dried.

To make the preservative residual ratio at most 10% in the ink passage, the preservative may be first forcedly injected into the ink passage so as to almost fully fill up the ink passage with the preservative. For example, a cartridge filled with a preservative may be fitted to the ink-jet head, and then the ink passage may be almost fully filled up with the preservative by driving an attached printer. In this stage, the ink passage may be filled as full as possible with the preservative to help ensure that the entire inner wall of the ink passage may be wetted with the preservative. After this, the preservative may be discharged to control the residual amount of the preservative in the ink passage.

To discharge the preservative, for example, the preservative may be sucked out of the nozzle side of the ink-jet head, or pressure may be applied to the nozzle side from the ink supply side to extrude the preservative out of the ink passage. For example, an empty cartridge may be fitted to the ink-jet head, and the ink-jet head may be repeatedly purged for predetermined times.

As explained above, the constitution of the ink-jet recording apparatus of embodiments of the invention may be the same as that of known ink-jet recording apparatus except that the preservative residual ratio in the ink passage of the ink-jet head may be controlled to fall within a predetermined range. The ink-jet mode of the apparatus of embodiments of the invention may be a thermal mode, a piezoelectric mode or any other mode.

The constitutive material of the ink passage may include, for example, a metal member of aluminium, stainless steel or the like to form the constitutive member of an ink-jet head, a piezoelectric element that acts as an ink ejection mechanism or a heating element, as well as an adhesive for bonding them, and also rubber members such as a cap and a sealing gasket to cover and seal up an ink-jet head nozzle.

The adhesive used in embodiments of the invention may include cold-curing adhesives (e.g., vinyl acetate-type, synthetic rubber-type, glue-type, nitrocellulose-type, urea-type, phenol-type, epoxy-type, polyurethane-type, cyanoacrylate-type, silicone-type, polyether acrylate-type), thermosetting adhesives (e.g., phenol-type, epoxy-type), and UV-curable adhesives (e.g., epoxy-type, acryl-type). To facilitate production of the apparatus, thermosetting adhesives may be used.

The rubber member used in embodiments of the invention may be formed of a rubber composition that comprises a rubber base polymer such as ethylene propylene diene rubber polymer (EPDM), isobutylene isoprene rubber polymer (IIR), and as formulated in any manner with a vulcanization agent such as zinc oxide, sulfur, organic peroxide and the like; a vulcanization accelerator such as thiazole compound, thiourea compound, thiuram compound, sulfenamide compound, dithiocarbamate compound and the like; a lubricant, for example, fatty acid salts such as calcium stearate, zinc stearate, magnesium stearate and the like, fatty acid derivatives such as stearic acid amide, oleic amide, erucaic amide, magnesium oxide and the like; a filler such as carbon black, calcium carbonate, silicon dioxide, talc, clay and the like; a softening agent such as paraffin oil and the like; scorch retarder.

The preservative in embodiments of the invention may comprise water, a penetrant, a humectant, a dispersing agent, a viscosity modifier, a surfactant, a pH modifier, a preservative-mildewproofing agent and a colorant as formulated in any manner. The preservative may have a controlled dynamic surface tension of from about 30 to about 45 mN/m at a lifetime of 100 ms as measured according to a maximum bubble pressure method at a measurement temperature of 25° C. If the dynamic surface tension thereof is smaller than about 30 mN/m, then the preservative may wet the rubber member of the ink passage excessively. It may also penetrate the rubber member excessively, causing swelling. In contrast, if the dynamic surface tension is larger than about 45 mN/m, then it is difficult to smoothly substitute ink for the preservative when ink is first introduced into the ink-jet head.

The dynamic surface tension may be measured according to a maximum bubble pressure method, as follows: A gas is fed into a probe from a gas supply source, and bubble is generated at the tip of the probe dipped in ink, whereupon the gas flow rate is varied so as to change the bubble-generating speed, and the surface tension of the ink is measured based on the varying pressure applied to the bubble from the ink. When the radius of the bubble is the same as the radius of the probe tip, then a maximum pressure (maximum bubble pressure) is shown. In this state, the dynamic surface tension of the ink, σ, is represented by the following formula:

$$\sigma=(\Delta P \cdot r)/2$$

wherein r indicates the radius of the probe tip,

ΔP indicates the difference between the maximum value and the minimum value of the pressure applied to the bubble.

The lifetime means a period of the time from when the gas bubble is caused to be away from the probe to form a new surface after the pressure reaches the maximum bubble pressure to when the pressure again reaches the maximum bubble pressure.

The penetrant may include, but is not limited to glycol ethers such as diethylene glycol methyl ether, diethylene glycol butyl ether, diethylene glycol isobutyl ether, dipropylene glycol methyl ether, dipropylene glycol propyl ether, dipropylene glycol isopropyl ether, dipropylene glycol butyl ether, triethylene glycol methyl ether, triethylene glycol butyl ether, tripropylene glycol methyl ether, tripropylene glycol butyl ether and the like. For the preservative to have the above-mentioned dynamic surface tension, the amount of glycol ether may be from about 3 wt. % to about 10 wt. %, or from about 4 wt. % to about 7 wt. % of the overall weight of the preservative.

The humectant may include, but is not limited to polyalcohols such as ethylene glycol, propylene glycol, diethylene glycol, triethylene glycol, dipropylene glycol, polyethylene glycol, polypropylene glycol, 1,3-butanediol, 1,5-pentanediol, 1,6-hexanediol, glycerin, 1,2,6-hexanetriol, 1,2,4-butanetriol, 1,2,3-butanetriol and the like; nitrogen-containing heterocyclic compounds such as N-methyl-2-pyrrolidone, N-hydroxyethyl-2-pyrrolidone, 2-pyrrolidone, 1,3-dimethylimidazolidinone, ε-caprolactam and the like; amides such as formamide, N-methylformamide, N,N-dimethylformamide and the like; amines such as ethanolamine, diethanolamine, triethanolamine, ethylamine, diethylamine, triethylamine and the like; sulfur-containing compounds such as dimethylsulfoxide, sulforane, thiodiethanol and the like; and the like.

In addition, a monoalcohol such as ethanol or isopropyl alcohol may be in the preservative for the purpose of controlling the penetrability and the driability of the preservative.

A method of storing ink-jet recording apparatus according to embodiments of the invention comprises storing an ink-jet recording apparatus in which the preservative residual ratio in the ink passage of the ink-jet head at most about 10%, as so mentioned hereinabove. For storage, if desired, the nozzle cap of the apparatus may be clamped and sealed up with a gas-impervious sealing bag. An apparatus prepared in this manner may be shipped or stored for a long period of time. After that, when the ink-jet recording apparatus is again used, then ink may be smoothly introduced into the ink-jet head, and the chance of ink-jet failure caused by nozzle clogging may be significantly reduced.

EXAMPLES

The invention is described more specifically with reference to the following Examples.

The following examples are provided only to illustrate certain aspects of the description and are not intended to embody the total scope of the invention or any aspect thereof. Variations of the exemplary embodiments below are intended to be included within the scope of the invention.

Examples 1 to 10 and Comparative Examples 1 to 8

(1) Preparation of Preservative and Ink:

The ingredients shown in Table 1 below were stirred and mixed to prepare Preservatives 1 and 2 and Inks 1 to 3.

(2) Control of Preservative Residual Ratio in Ink-Jet Head:

The preservative and the ink were combined with a printer as in Table 2 or Table 3. In the manner mentioned below, the ink-jet head of the printer was filled with preservative, then purged to control the preservative residual ratio therein, and thereafter the ink-jet head was filled with ink. In Comparative Examples 5 to 7, ink was used in place of the preservative.

In a digital multifunction device equipped with inkjet printer DCP-110C producted by Brother Industries, Ltd. (a piezo-type printer with a head unit and an ink cartridge separately built therein) or in an ink-jet printer BJ-S700 producted by Canon Inc. (a thermal-type printer with an ink cartridge directly mounted on the head unit therein), four cartridges with the same preservative therein were fitted to the sites where ordinary ink cartridges are to be fitted (four sites for black, yellow, magenta and cyan ink cartridges), and the ink-jet head was thus filled fully with the preservative.

Next, the preservative cartridges were removed, and empty cartridges were fitted to the sites, which were then purged for predetermined times to thereby remove the preservative from in the ink passage. Next, the empty cartridges were removed, and the head unit was taken off from the printer, and the weight of the head unit where the preservative remained in the ink passage was measured with an electronic balance (minimum detection limit, 0.01 g). On the other hand, the weight of the empty head unit with no preservative introduced thereinto (blank weight) was also measured. From the difference between the two, the weight of the remaining preservative was obtained. The weight of the remaining preservative was divided by the specific gravity of the preservative to give a volume of the remaining preservative. According to the following formula, the preservative residual ratio was obtained. The results are given in Table 2 and Table 3.

Preservative Residual Ratio={[Residual Preservative Volume]/[Inner Volume of Ink Passage]}×100.

The blank weight of the head unit and the inner volume of the ink passage were obtained as follows: The ink passage of the ink-jet head was filled fully with pure water, and its weight was measured with an electronic balance (minimum detection limit, 0.01 g) (this is "weight filled with pure water"), and then pure water was removed from the ink passage. This was left in a thermostatic chamber at a temperature of 50° C. and a humidity of 30% RH for 1 week, and its weight was measured at room temperature. This is the "blank weight". The blank weight was subtracted from the weight filled with pure water to obtain the weight of the pure water fully filled in the ink passage. The specific gravity of pure water is 1, and the inner volume of the ink passage was obtained from the weight of the pure water fully filled therein.

(3) Evaluation of Initial Ink Introducibility:

The ink-jet head in which the preservative residual ratio had been controlled in (2) was stored in a thermostatic chamber at a temperature of 50° C. and a humidity of 30% RH for 3 weeks, and then restored to room temperature. The ink-jet head was fitted to the printer. Then, four ink cartridges of the same color were fitted to the four ink cartridge-fitting sites of the printer. Immediately after the initial introduction operation thereof, the printer was used for test printing, whereupon the proportion of the nozzles of good ink-jet condition to all the nozzles in the test printing was determined. Based on the following criteria, the tested printers were evaluated in 3 ranks. The results are given in Table 2 and Table 3.

A: The proportion of the nozzles of good ink-jet condition in test printing is 95% or more.

B: The proportion of the nozzles of good ink-jet condition in test printing is 90% or more but less than 95

C: The proportion of the nozzles of good ink-jet condition in test printing is less than 90%.

(4) Evaluation in Printing after Storage:

After the evaluation of initial ink introducibility in (3), the ink cartridges were removed, and the ink-jet head was stored in a thermostatic chamber at a temperature of 50° C., and a humidity of 30% RH for 2 weeks, and then restored to room temperature. The ink-jet head was then fitted to the printer, and ink cartridges were also fitted thereto. The printer was subjected to normal purging once, and then used for test printing, whereupon the proportion of the nozzles of good ink-jet condition to all the nozzles in the test printing was determined. Based on the following criteria, the tested printers were evaluated in 3 ranks. The results are given in Table 2 and Table 3.

A: The proportion of the nozzles of good ink-jet condition in test printing is 95% or more.

B: The proportion of the nozzles of good ink-jet condition in test printing is 90% or more but less than 95%.

C: The proportion of the nozzles of good inkjet condition in test printing is less than 90%.

TABLE 1

(unit: % by weight)

| | Preservative 1 | Preservative 2 | Ink 1 | Ink 2 | Ink 3 |
|---|---|---|---|---|---|
| C.I. Direct Yellow 86 | — | — | 2.5 | — | — |
| C.I. Acid Red 52 | — | — | — | — | 2.0 |
| C.I. Direct Blue 199 | — | — | — | 3.0 | — |
| Glycerin | 17.0 | 15.0 | 18.0 | 22.0 | 25.0 |
| Triethylene Glycol-n-butyl Ether | 5.0 | 7.0 | 7.0 | 3.0 | — |
| Dipropylene Glycol-n-propyl Ether | — | — | — | — | 0.8 |
| OLFINE ® E1010 *1 | 0.3 | 0.3 | — | — | — |
| SANNOL ® NL-1430 *2 | — | — | 0.1 | 0.2 | 0.1 |
| Proxel XL-2(S) *3 | 0.2 | 0.2 | 0.2 | 0.2 | 0.2 |
| Water | balance | balance | balance | balance | balance |

*1: acetylene glycol-type surfactant; product of Nisshin Chemical Industry Co., Ltd.

*2: polyoxyethylene alkyl ether sulfate-type surfactant; product of Lion Corporation

*3: mildewproofing agent; product of Arch Chemicals Inc.

TABLE 2

| | Example 1 | Example 2 | Example 3 | Example 4 | Example 5 | Example 6 | Example 7 | Example 8 | Example 9 | Example 10 |
|---|---|---|---|---|---|---|---|---|---|---|
| | Preservative | | | | | | | | | |
| | Preservative 1 | Preservative 1 | Preservative 1 | Preservative 2 | Preservative 2 | Preservative 2 | Preservative 1 | Preservative 2 | Preservative 1 | Preservative 2 |
| Frequency of Purging (times) | 8 | 10 | 10 | 10 | 10 | 10 | 15 | 15 | 2 | 2 |
| Preservative Residual Ratio (%) | 8.5 | 5.5 | 6.0 | 6.0 | 5.0 | 5.0 | 3.0 | 2.5 | 8.2 | 8.5 |
| Ink | Ink 1 | Ink 2 | Ink 3 | Ink 1 | Ink 2 | Ink 3 | Ink 2 | Ink 2 | Ink 1 | Ink 1 |
| Printer Used *1 | DCP-110C | DCP-110C | DCP-110C | DCP-110C | DCP-110C | DCP-110C | DCP-110C | DCP-110C | BJ-S700 | BJ-S700 |
| Evaluation of Initial Ink Introducibility | A | B | A | A | A | A | B | A | A | A |
| Evaluation in Printing after Storage | A | A | A | B | B | B | A | A | A | A |

*1: DCP-110C: product of Brother Industries, Ltd.; a digital multifunction device equipped with ink-jet printer BJ-S700: product of Canon Inc.; an ink-jet printer

TABLE 3

| | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|
| | Preservative | | | | | | | |
| | Preservative 1 | Preservative 2 | Preservative 1 | Preservative 2 | Ink 1 | Ink 2 | Ink 3 | Preservative 1 |
| Frequency of Purging (times) | 2 | 2 | 1 | 1 | 10 | 10 | 10 | 1 |
| Preservative Residual Ratio (%) | 18.0 | 20.0 | 93.0 | 94.0 | 5.5 | 5.0 | 5.5 | 24.0 |
| Ink | ink 2 | ink 2 | ink 1 | ink 2 | ink 1 | ink 2 | ink 3 | ink 1 |
| Printer Used *1 | DCP-110C | DCP-110C | DCP-110C | DCP-110C | DCP-110C | DCP-110C | DCP-110C | BJ-S700 |
| Evaluation of Initial Ink Introducibility | B | B | C | C | C | C | C | C |
| Evaluation in Printing after Storage | C | C | C | C | A | B | B | C |

*1: DCP-110C: product of Brother Industries, Ltd.; a digital multifunction device equipped with ink-jet printer BJ-S700: product of Canon Inc.; an ink-jet printer As in Table 2 and Table 3, both the evaluation of initial ink introducibility and the evaluation in printing after storage were good in Examples 1 to 10 where the preservative residual ratio in the ink passage was no greater than 10%, but in Examples 1 to 4 and 8 where the preservative residual ratio was more than 10%, either the evaluation of initial ink introducibility or the evaluation in printing after storage was bad. In Comparative Examples 5 to 7 where ink was used in place of the preservative, the evaluation of initial ink introducibility was bad.

As described in detail hereinabove with reference to the preferred embodiments thereof, the invention is useful as an aspect of shipping and long-term storage of ink-jet recording apparatus.

Although embodiments of the present invention have been described in detail herein, the scope of the invention is not limited thereto. It will be appreciated by those of ordinary skill in the relevant art that various modifications may be made without departing from the scope of the invention. Accordingly, the embodiments disclosed herein are exemplary. It is to be understood that the scope of the invention is not to be limited thereby, but is to be determined by the claims which follow.

What is claimed is:

1. An inkjet recording apparatus comprising:

an ink-jet head comprising an ink passage having an inner volume; and a preservative in the ink passage, such that a preservative residual ratio is no greater than 10% of the inner volume.

2. The ink-jet recording apparatus according to claim 1, wherein the ink-jet recording apparatus further comprises a piezoelectric element.

3. The ink-jet recording apparatus according to claim 1, wherein the ink-jet recording apparatus further comprises a thermal-ejection system.

4. The ink-jet recording apparatus according to claim 1, wherein the ink passage comprises aluminum or stainless steel.

5. The inkjet recording apparatus according to claim 1, further comprising an adhesive.

6. The ink-jet recording apparatus according to claim 1, further comprising a rubber member.

7. The ink-jet recording apparatus according to claim 1, wherein a dynamic surface tension of the preservative is between about 30 mN/m and 40 mN/m, as measured at 25° C., at a lifetime of 100 ms using a maximum bubble pressure method.

8. The ink-jet recording apparatus according to claim 1, wherein the preservative comprises glycol ether in an amount from about 3 wt. % to about 10 wt. % of an overall weight of the preservative.

9. The ink-jet recording apparatus according to claim 1, where the preservative comprises a monoalcohol.

10. An ink-jet recording apparatus comprising:

an ink-jet head means for containing a preservative and allowing flow of ink; and a preservative means for limiting a preservative residual ratio to no greater than 10% of an inner volume of the inkjet head means.

11. The ink-jet recording apparatus according to claim 10, further comprising a means for piezoelectric printing.

12. The ink-jet recording apparatus according to claim 10, further comprising a means for thermal-ejection printing.

13. A processing method comprising:

filling an inner volume of an ink passage in an ink-jet recording apparatus with a preservative; and removing a portion of the preservative from the inner volume, such that a preservative residual ratio is no greater than 10%.

14. The method according to claim 13, further comprising clamping a nozzle cap of the apparatus.

15. The method according to claim 13, further comprising sealing a nozzle cap of the apparatus with a sealing bag.

16. The method according to claim 13, further comprising storing the ink-jet apparatus.

17. The method according to claim 13, further comprising shipping the ink-jet apparatus.

18. The method according to claim 13, further comprising reducing a rate of ink-jet failure of the ink-jet recording apparatus when ink-jet recording apparatus is first used for printing.

19. The method according to claim 13, further comprising reducing an amount of a constituent material of the ink-jet apparatus dissolved by the preservative.

20. The method according to claim 13, further comprising facilitating the flow of an ink into the ink passage ink-jet recording apparatus when ink-jet recording apparatus is first used for printing.

* * * * *